US010105029B2

(12) United States Patent
Zhu

(10) Patent No.: US 10,105,029 B2
(45) Date of Patent: Oct. 23, 2018

(54) SWEEPER MACHINE

(71) Applicant: Jiaxing Jackson Travel Products Co., Ltd., Jiaxing, Zhejiang (CN)

(72) Inventor: Xue Lin Zhu, Jiaxing (CN)

(73) Assignee: JIAXING JACKSON TRAVEL PRODUCTS CO., LTD., Zhejiang (CN)

( * ) Notice: Subject to any disclaimer, the term of this patent is extended or adjusted under 35 U.S.C. 154(b) by 158 days.

(21) Appl. No.: 15/236,932

(22) Filed: Aug. 15, 2016

(65) Prior Publication Data

US 2017/0055793 A1 Mar. 2, 2017

(30) Foreign Application Priority Data

Aug. 25, 2015 (CN) ..... 2015 2 0647330

(51) Int. Cl.

| | |
|---|---|
| ***A47L 11/22*** | (2006.01) |
| ***A47L 13/52*** | (2006.01) |
| ***A46B 13/00*** | (2006.01) |
| ***A46B 13/08*** | (2006.01) |

(52) U.S. Cl.

CPC ..... *A47L 11/22* (2013.01); *A46B 13/001* (2013.01); *A46B 13/08* (2013.01); *A47L 13/52* (2013.01)

(58) Field of Classification Search

CPC ..... A47L 11/22; A47L 13/52; A46B 13/001; A46B 13/08

USPC ..... 15/41.1

See application file for complete search history.

(56) References Cited

U.S. PATENT DOCUMENTS

| | | | | | |
|---|---|---|---|---|---|
| 3,003,170 | A * | 10/1961 | Lathrop | A47L 11/33 | 15/41.1 |
| 3,097,383 | A * | 7/1963 | Taylor | A47L 11/22 | 15/41.1 |
| 3,744,077 | A * | 7/1973 | Smyth | A47L 11/33 | 15/41.1 |
| 3,789,454 | A * | 2/1974 | Drappeu | A47L 11/33 | 15/41.1 |
| 4,709,436 | A * | 12/1987 | Berfield | A47L 11/33 | 15/257.9 |
| 5,239,721 | A * | 8/1993 | Zahuranec | A47L 11/32 | 15/41.1 |
| 6,966,098 | B2 | 11/2005 | Sako et al. | | |
| 7,134,161 | B2 * | 11/2006 | Campos | A47L 11/32 | 15/48.1 |

(Continued)

*Primary Examiner* — Weilun Lo

(74) *Attorney, Agent, or Firm* — Muncy, Geissler, Olds & Lowe, P.C.

(57) ABSTRACT

A sweeper machine comprises a support frame, a machine body, and a garbage collection case. The support frame includes two fixing arms. The machine body is disposed between and mounted to the two fixing arms. The garbage collection case is inserted to the rear side of the machine body. Each fixing arm includes a driving wheel. The machine body includes a body casing and a roll brush. The roll brush is disposed inside the body casing. The body casing includes an opening. The lower part of the roll brush is exposed from the opening. Two first connection holes are respectively formed on two ends of the body casing. Each driving shaft extends out of the fixing arm and penetrates one connection hole. Two ends of the roll brush are respectively firmly connected with the two driving shafts separately penetrating the two first connection holes.

9 Claims, 9 Drawing Sheets

(56) References Cited

U.S. PATENT DOCUMENTS

| | | | | |
|---|---|---|---|---|
| 2003/0204923 | A1* | 11/2003 | Nakamura | A46B 13/02 15/4 |
| 2004/0143919 | A1* | 7/2004 | Wilder | A47L 11/33 15/41.1 |
| 2004/0181888 | A1* | 9/2004 | Tawara | A47L 11/33 15/41.1 |
| 2004/0205915 | A1* | 10/2004 | Sin | A47L 11/32 15/48.1 |
| 2005/0055785 | A1* | 3/2005 | Spooner | A47L 11/33 15/41.1 |
| 2010/0115719 | A1* | 5/2010 | West | A47L 7/02 15/41.1 |

* cited by examiner

SWEEPER MACHINE

FIELD OF THE INVENTION

The present invention relates to a cleaning device, particularly to a sweeper machine.

BACKGROUND OF THE INVENTION

Most of the conventional sweeper machines are driven by electricity. A U.S. Pat. No. 6,966,098 disclosed an electric sweeper machine, wherein a hairbrush is driven by electricity to rotate and collect garbage on the floor. In order to acquire an appropriate rotation speed of the hairbrush from a motor, the conventional electric sweeper machine needs a complicated transmission device, which requires precision fabrication and precise installation. Even a minor error would affect the transmission efficiency of the transmission device and increase the failure rate of the electric sweeper machine.

Besides, a common electric sweeper machine also needs a battery, a power management device, and a controller. The abovementioned devices would increase the investment of research and development and raise the cost of fabrication. Further, the reliability of the conventional electric sweeper machines is insufficient.

Besides, there are also human-powered sweeper machine currently. However, the garbage is likely to drop out of the collection chamber while the current human-powered sweeper machine is lifted up from the floor.

SUMMARY OF THE INVENTION

The primary objective of the present invention is to provide a sweeper machine to solve the problem of high cost and low reliability of the conventional electric sweeper machines.

Another objective of the present invention is to solve the problem that garbage is likely to drop out of the collection chamber of the conventional human-powered sweeper machine.

In order to achieve the abovementioned objective, the present invention proposes a sweeper machine, which comprises a support frame, a machine body, and a garbage collection case. The support frame includes two fixing arms. Each fixing arm includes a driving wheel, a first gear and a second gear. The driving wheel protrudes from the terminal of the fixing arm where the driving wheel is installed. The driving wheel is coaxially coupled to the second gear, and the second gear is meshed with the first gear. The first gear is further coaxially coupled to a driving shaft. The driving shaft is extended out of the fixing arm where the driving shaft is installed. The machine body is disposed between and mounted to the two fixing arms and includes a body casing and a roll brush. The roll brush is disposed inside the body casing. The body casing includes an opening formed and extended in the rear side of the bottom of the body casing. The lower part of the roll brush is exposed from the opening. Two first connection holes are respectively formed on two ends of the body casing. Each driving shaft, which extends out of the fixing arm, penetrates one connection hole. Two ends of the roll brush are respectively firmly connected with the two driving shafts separately penetrating the two first connection holes. The garbage collection case is disposed in the opening in the rear side of the body casing and includes a garbage receiving opening facing the roll brush.

In one embodiment, the support frame includes a main casing. The main casing includes two fixing-arm shells branching out toward two lateral sides of the main casing. Each fixing-arm shell includes a fixing-arm side cover on the outer side thereof. Each fixing-arm shell and the fixing-arm side cover thereof include an accommodation space therebetween. Each accommodation space accommodates the driving wheel, the first gear and the second gear.

In one embodiment, each fixing-arm shell includes a first annular limit protrusion. Each fixing-arm side cover includes a second annular limit protrusion. Two sides of each second gear respectively include two annular positioning grooves separately assembled to the first annular limit protrusion and the second annular limit protrusion.

In one embodiment, the driving wheel has an annular shape; each driving wheel sleeves and engages with the outer side of one of the second gears. The second gear is an internal gear, and the first gear is an external gear. The first gear is disposed inside the second gear and meshed with the second gear.

In one embodiment, the top of the body casing includes an adapter, which is hinged to the body casing with a pin. The adapter is fixedly connected with a swing member. The swing member is connected with a sweeper handle by a connection member.

In one embodiment, each fixing-arm side cover includes a bump cover on the outer side thereof.

In one embodiment, a torsion spring is disposed between the machine body and each of the fixing arms. Two machine-body side covers are respectively assembled to two sides of the body casing. Each machine-body side cover includes a second connection hole coaxial with the first connection hole and an arc-shaped limit groove penetrating the machine-body side cover. The circle center of the arc-shaped limit groove is on the axis of the second connection hole. The rim of the first connection hole extends toward the corresponding machine-body side cover to form a fixing shaft. The body casing includes two limit blocks respectively at two sides thereof. The torsion spring includes a helically-wound spring body and also includes a first spring arm and a second spring arm respectively extended from two ends of the spring body. The spring body sleeves the fixing shaft. The first spring arm presses against the limit block. The fixing arm includes a limit pillar. The limit pillar is inserted into the arc-shaped limit groove and presses against the second spring arm.

In one embodiment, the garbage receiving opening includes a scraper strip disposed on the edge of the bottom of the garbage receiving opening and cooperating with the roll brush. The garbage collection case includes at least one recess concaved upward from the bottom thereof. An auxiliary roller is assembled in the recess.

In one embodiment, the top of the body casing includes an assembly opening corresponding to the top of the garbage collection case and a garbage collection case cover assembled to the assembly opening.

In comparison with the conventional technology, the present invention is characterized in that the sweeper machine of the present invention is driven manually and thus a human-powered sweeper machine exempted from the complicated and precision transmission device of an electric sweeper machine. Therefore, the sweeper machine of the present invention has advantages of low cost and high reliability. Further, while the sweeper machine of the present invention is lifted up from the floor, the torsion spring instantly overturns the garbage collection case to make the garbage receiving opening face upward and prevent the garbage from dropping out of the garbage receiving opening.

DETAILED DESCRIPTION OF THE PREFERRED EMBODIMENTS

The technical contents of the present invention will be described in detail in cooperation with drawings below.

Figure 1:
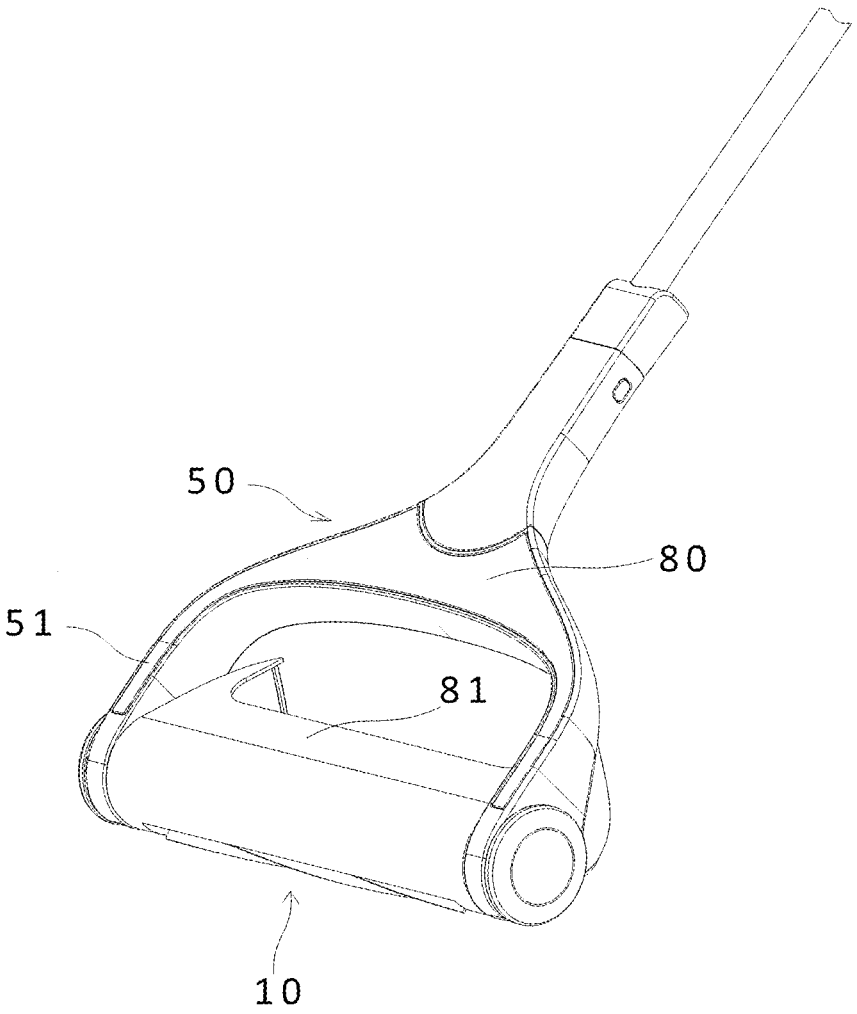
FIG. 1 is a perspective view schematically showing a sweeper machine without a garbage collection according to one embodiment of the present invention.
Figure 2:
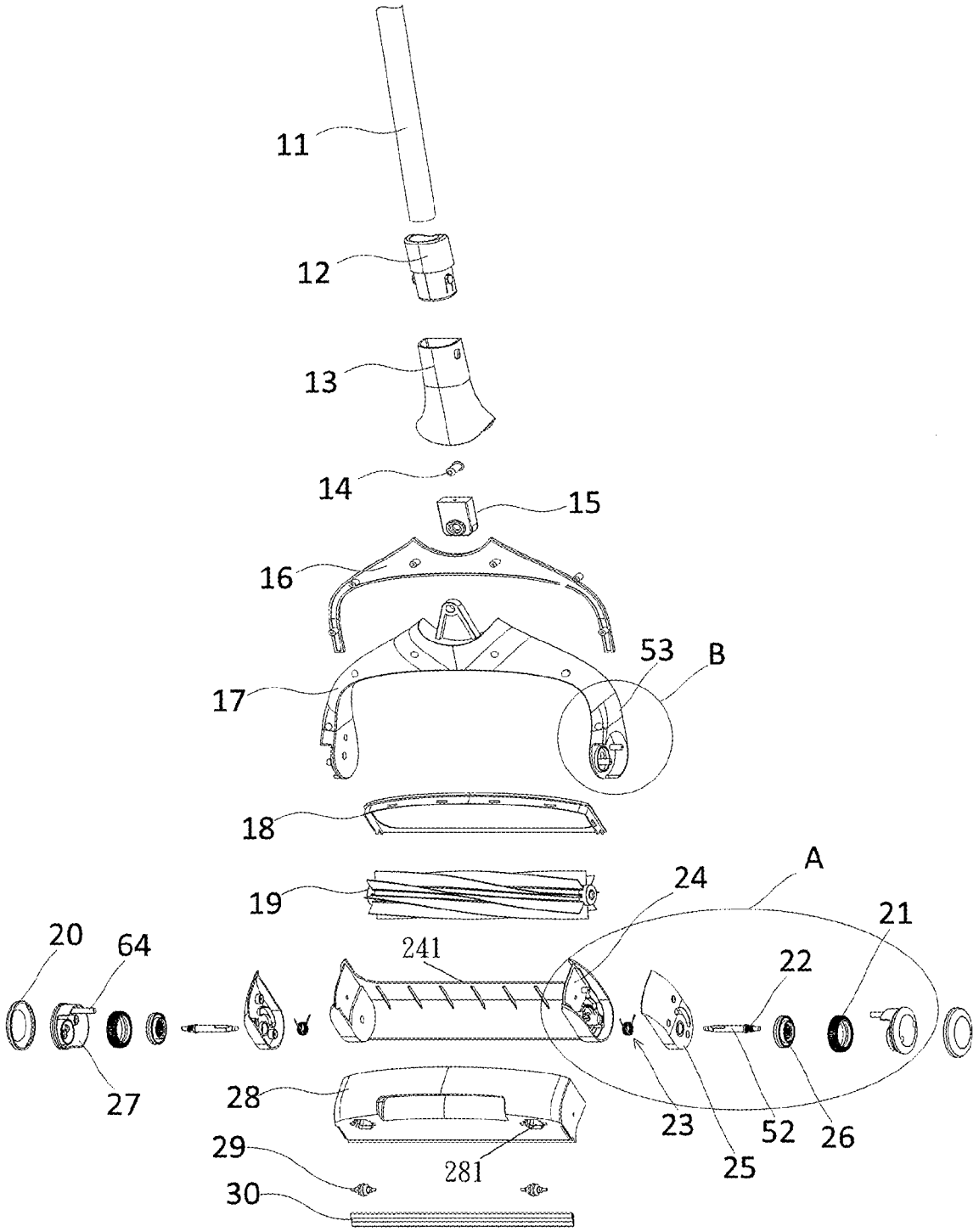
FIG. 2 is an exploded view schematically showing a sweeper machine according to one embodiment of the present invention.
Figure 10:
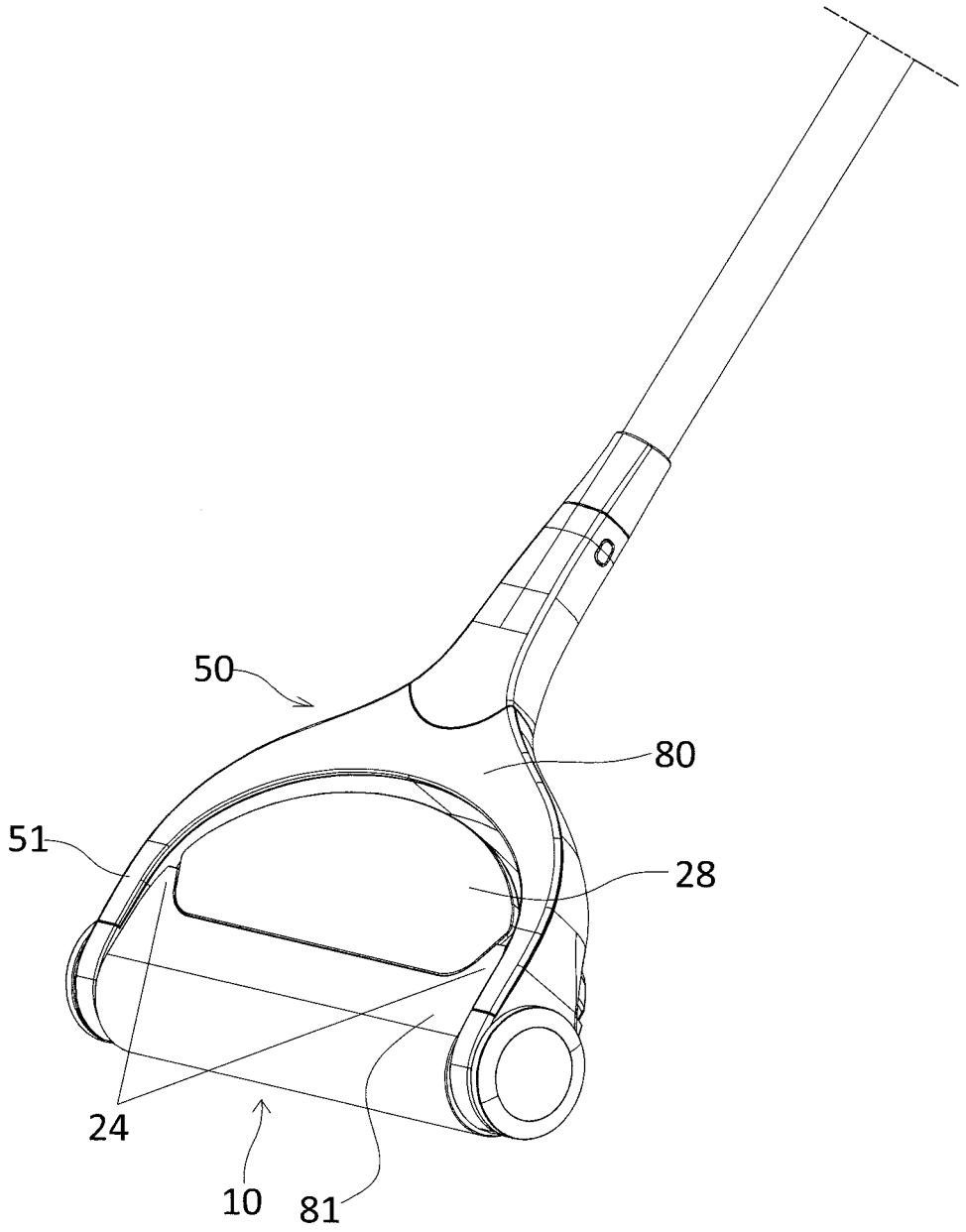
FIG. 10 is a perspective view schematically showing a sweeper machine with a garbage collection according to one embodiment of the present invetion

Refer to FIG. 1, FIG. 2, and FIG. 10. The sweeper machine of the present invention comprises a support frame 50, a machine body 10, and a garbage collection case 28. The support frame 50 includes two fixing arms 51. The machine body 10 is disposed between and mounted to the two fixing arms 51. The garbage collection case 28 is inserted to the rear side of the machine body 10. The two fixing arms 51 extend toward an identical direction and include a U-shaped structure. The space defined by the two fixing arms 51 is exactly sufficient to accommodate the machine body 10 and the garbage collection case 28.

Figure 3:
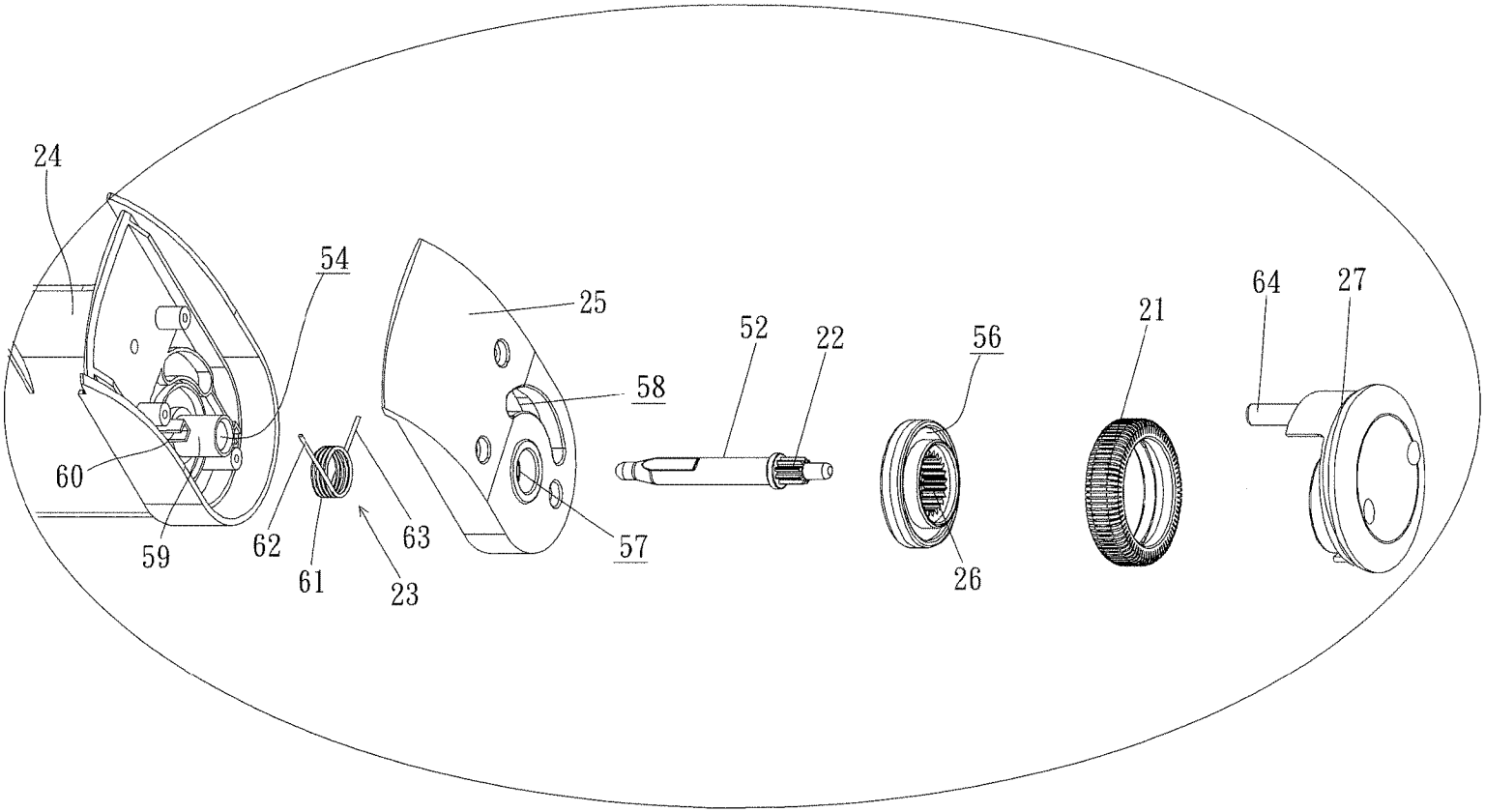
FIG. 3 is an enlarged view of Region A in FIG. 2.
Figure 4:
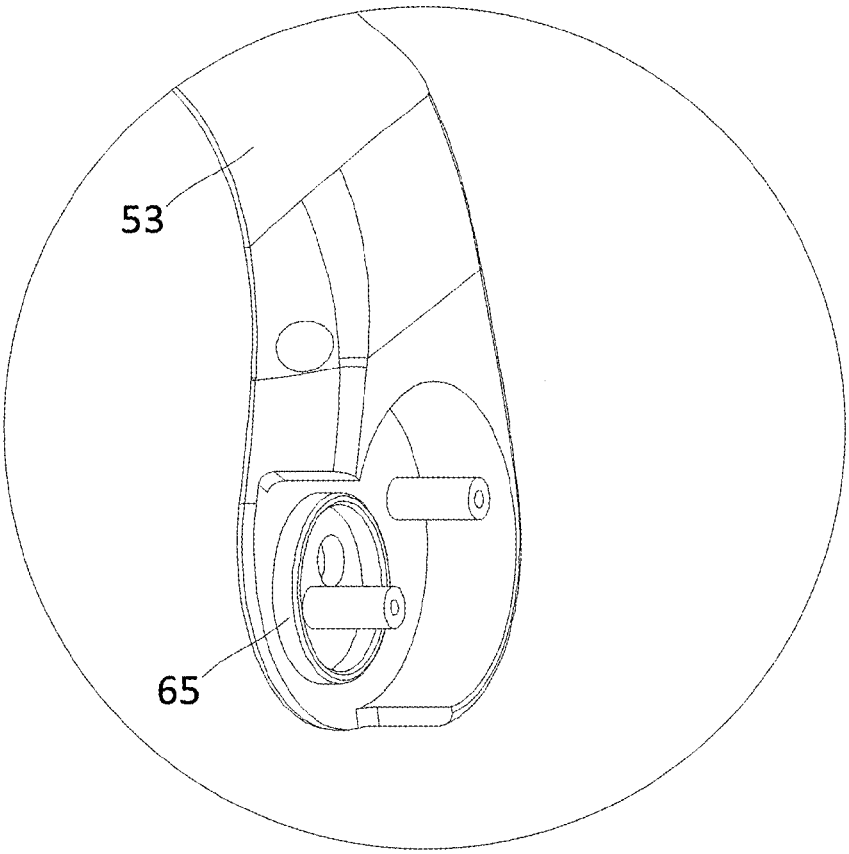
FIG. 4 is an enlarged view of Region B in FIG. 2.

Refer to FIG. 2 and FIG. 3. Each fixing arm 51 includes a driving wheel 21, a first gear 22 and a second gear 26. The driving wheel 21 protrudes from the terminal of the fixing arm 51 where the driving wheel 21 is installed. The driving wheel 21 is coaxially coupled to the second gear 26, and the second gear 26 is meshed with the first gear 22. The first gear 22 is further coaxially coupled to a driving shaft 52. The driving shaft 52 is extended out of the fixing arm 51 where the driving shaft 52 is installed.

Figure 7:
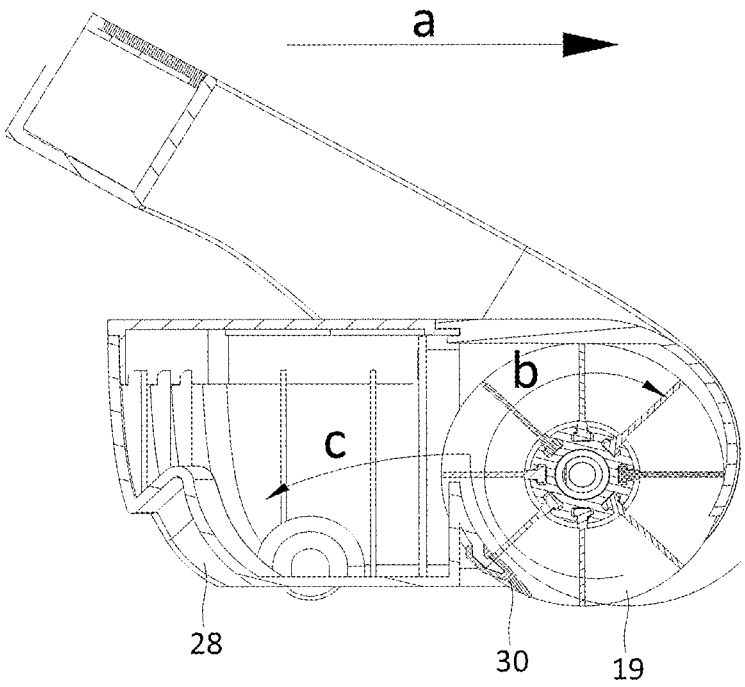
FIG. 7 is a diagram schematically showing operation of a sweeper machine according to one embodiment of the present invention.

Refer to FIG. 2, FIG. 3 and FIG. 7. The machine body 10 includes a body casing 24 and a roll brush 19. The roll brush 19 is disposed inside the body casing 24. The body casing 24 includes an opening 241 formed and extended in the rear side of the bottom of the body casing 24. The lower part of the roll brush 19 is exposed from the opening 241. Two first connection holes 54 are respectively formed on two ends of the body casing 24. The driving shaft 52, which extends out of the fixing arm 51, penetrates the first connection hole 54. Two ends of the roll brush 19 are respectively firmly connected with the two driving shafts 52 separately penetrating the two first connection holes 54.

Refer to FIG. 2 and FIG. 3 again. In one embodiment, the shell of the support frame 50 includes a main casing 17 and a cover 16. The main casing 17 includes two fixing-arm shells 53 branching out toward the two lateral sides of the main casing 17. The two fixing-arm shells 53 are respectively corresponding to the two fixing arms 51. Each fixing-arm shell 53 includes a fixing-arm side cover 27 on the outer side of the fixing-arm shell 53. Each fixing-arm shell 53 and the fixing-arm side cover 27 thereof include an accommodation space therebetween. Each accommodation space accommodates the driving wheel 21, the first gear 22 and the second gear 26. Each fixing-arm side cover 27 includes a bump cover 20 to enhance the bump resistance of the sweeper machine of the present invention and prevent the sweeper machine from colliding with another object and leaving scratches on the object.

Refer to FIGS. 2-6. Each fixing-arm shell 53 includes a first annular limit protrusion 65. Each fixing-arm side cover 27 includes a second annular limit protrusion 55. Two sides of each second gear 26 respectively include two annular positioning grooves 56 separately assembled to the first annular limit protrusion 65 and the second annular limit protrusion 55. The present invention uses the first annular limit protrusion 65 and the second annular limit protrusion 55 to install the second gear 26 inside the accommodation space between the fixing-arm shell 53 and the fixing-arm side cover 27.

Figure 6:
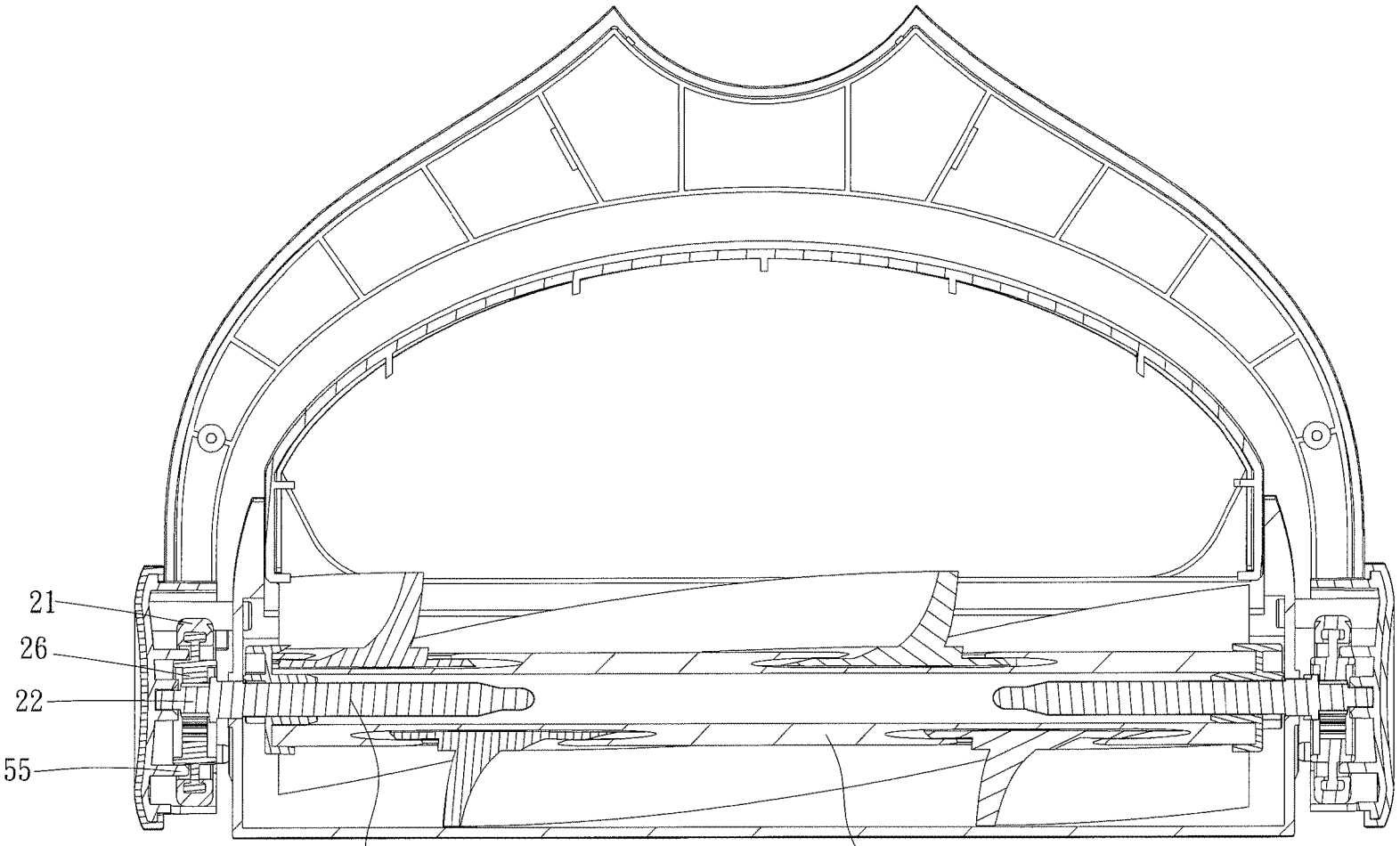
FIG. 6 is a sectional view schematically showing a support frame and a machine body of a sweeper machine according to one embodiment of the present invention.

Refer to FIG. 2, FIG. 3 and FIG. 6. In one embodiment, the driving wheel 21 has an annular shape. Each driving wheel 21 sleeves and engages with the outer side of one of the second gears 26. The second gear 26 is an internal gear, and the first gear 22 is an external gear. The first gear 22 is disposed inside the second gear 26 and meshed with the second gear 26.

Refer to FIG. 2 and FIG. 7. The garbage collection case 28 is inserted into the opening 241 in the rear side of the body casing 24. The garbage collection case 28 includes a garbage receiving opening facing the roll brush 19. The garbage receiving opening includes a scraper strip 30 disposed on the edge of the bottom thereof and cooperating with the roll brush 19. The garbage collection case 28 includes at least one recess 281 concaved upward from the bottom thereof. An auxiliary roller 29 is assembled in the recess 281 to prevent the bottom of the garbage collection case 28 from scratching the floor.

Refer to FIG. 2, FIG. 3, FIG. 6 and FIG. 7. While the sweeper machine of the present invention is pushed to move along a first direction a shown in FIG. 7, the driving wheels 21 respectively protruding from the terminals of the two fixing arms 51 rub against the floor and rotate. The second gear 26 inside the driving wheel 21 also rotates synchronously with the driving wheel 21. Then, the first gear 22 meshing with the second gear 26 also rotates. As the second gear 26 is coaxially coupled to the driving shaft 52, the driving shaft 52 also rotates synchronously with the second gear 26. Thus, the roll brush 19 whose two ends are respectively coupled to the driving shafts 52 also rotates with the driving shafts 52. As shown in FIG. 7, while the sweeper machine is pushed to move along the direction a, the roll brush 19 rotates along a direction b. Thus, the garbage before the sweeper machine is driven by the roll brush 19 to enter the garbage collection case 28 along a direction c. At the same time, the scraper strip 30 disposed on the edge of the bottom of the garbage receiving opening contacts the floor tightly. Further, the side face of the scraper strip 30 is designed to be an incline. Thus, the scraper strip 30 enables the sweeper machine to collect the garbage into the garbage collection case 28 more easily.

Figure 8:
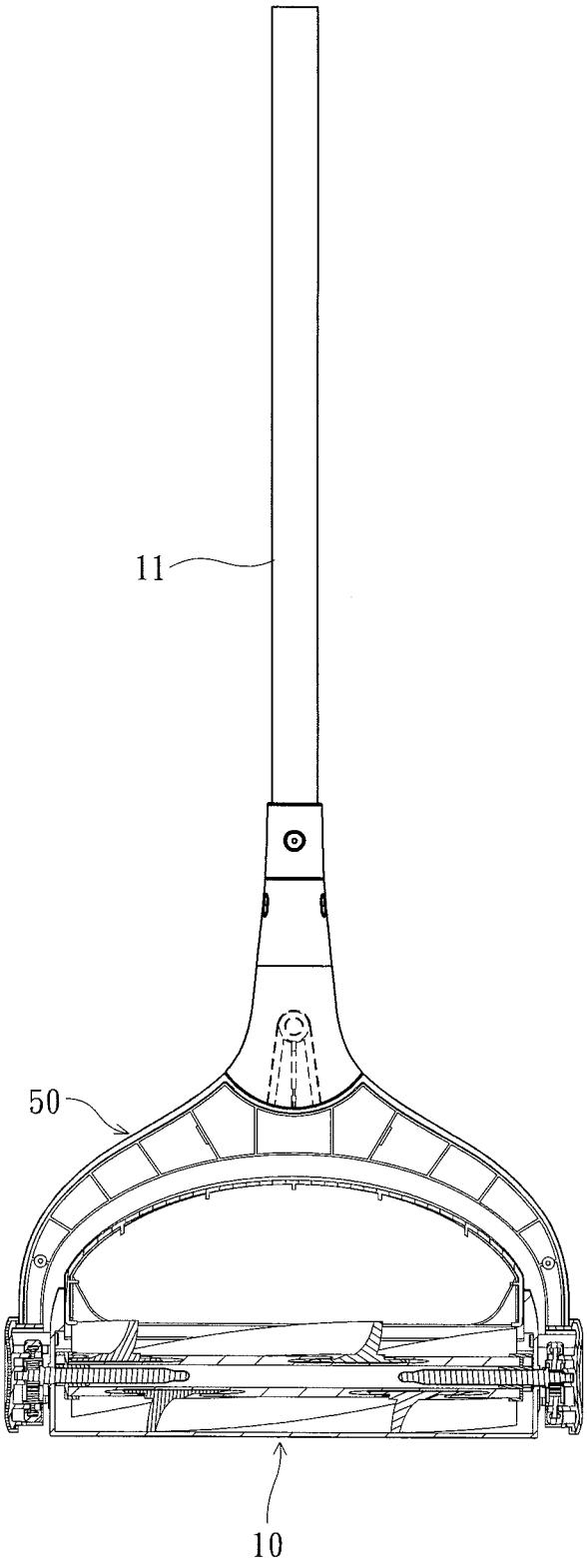
FIG. 8 is a sectional view schematically showing a sweeper machine according to one embodiment of the present invention.
Figure 9:
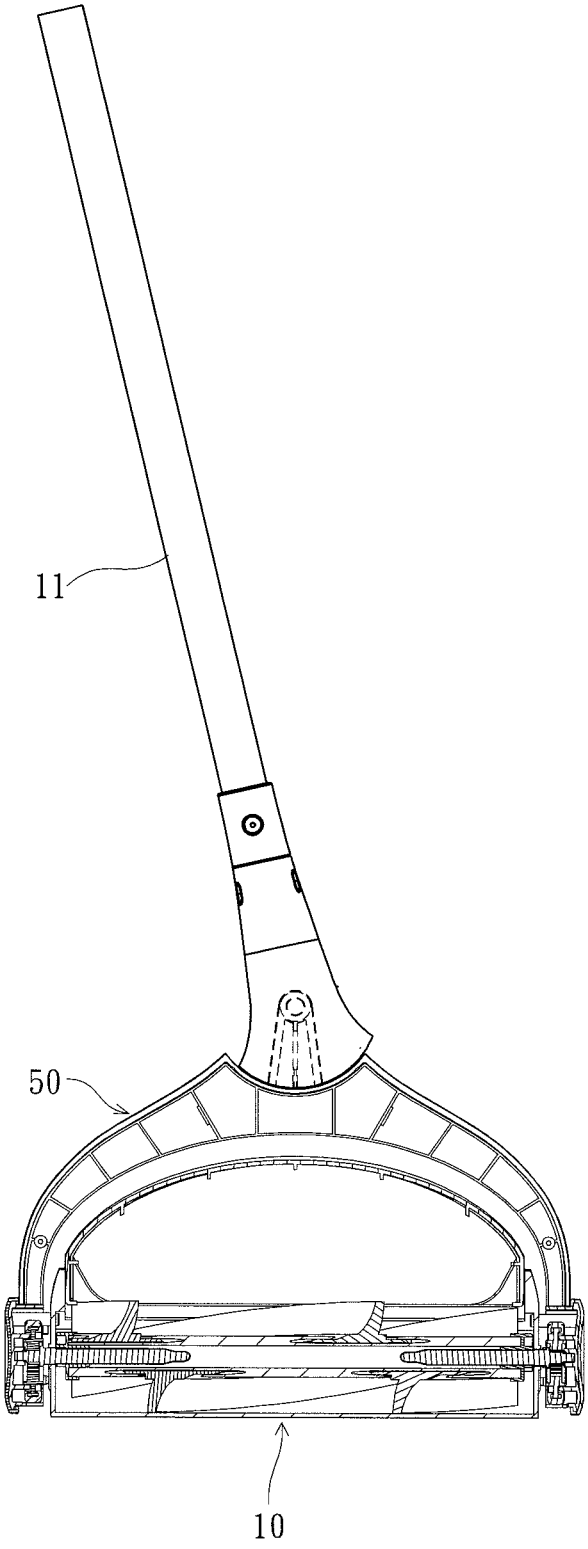
FIG. 9 is a diagram schematically showing operation of a sweeper handle of a sweeper machine according to one embodiment of the present invention.

Refer to FIG. 1 and FIG. 2. In one embodiment, the top of the body casing 24 includes an adapter 15, which is hinged to the body casing 24 with a pin 14. The adapter 15 is fixedly connected with a swing member 13. The swing member 13 is connected with a sweeper handle 11 by a connection member 12. Refer to FIG. 8 and FIG. 9. The sweeper handle 11 can swing leftward and rightward. Via the abovementioned design, the sweeper machine can be operated more nimbly to clean the place where the sweeper handle 11 is hard to reach. In further detail, as two sides of the machine body 10 are respectively assembled to the two fixing arms 51 through the two driving shafts 52, the machine body 10 can rotate with the driving shafts 52 being the axis. While the sweeper handle 11 is tilted toward the floor, the fixing arms 51 also tilt toward the floor with the posture of the machine body 10 remaining unchanged. While the sweeper handle 11 is parallel to the floor, a top face 81 of the machine body 10 is coplanar with a top face 80 of the support frame 50. Thereby, the user can use the sweeper handle 11 to push the machine body 10 to a narrow space, such as the underneath of a sofa, and clean the space.

Figure 5:
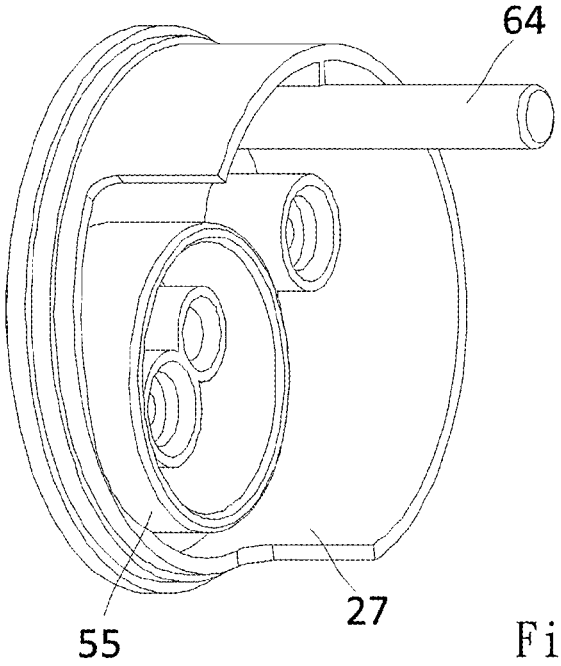
FIG. 5 is a perspective side view schematically showing a fixing-arm side cover according to one embodiment of the present invention.

Refer to FIG. 2 and FIG. 5. A torsion spring 23 is disposed between the machine body 10 and each of the fixing arms 51. Two machine-body side covers 25 are respectively assembled to two sides of the body casing 24. Each machine-body side cover 25 includes a second connection hole 57 coaxial with the first connection hole 54 and an arc-shaped limit groove 58 penetrating the machine-body side cover 25. The circle center of the arc-shaped limit groove 58 is on the axis of the second connection hole 57. The rim of the first connection hole 54 extends toward the corresponding machine-body side cover 25 to form a fixing shaft 59. The body casing 24 includes two limit blocks 60 respectively at two sides thereof. The torsion spring 23 includes a helically-wound spring body 61 and also includes a first spring arm 62 and a second spring arm 63 respectively extended from two ends of the spring body 61. The spring body 61 sleeves the fixing shaft 59, and the first spring arm 62 presses against the limit block 60. The fixing arm 51 includes a limit pillar 64 formed on the fixing-arm side cover 27. The limit pillar 64 penetrates the fixing-arm shell 53 and the arc-shaped limit groove 58. The limit pillar 64 is inserted into the arc-shaped limit groove 58 and presses against the second spring arm 63. The torsion spring 23 is used to apply force to the machine body 10 and the two fixing arms 51, whereby an angle can be stably kept between the machine body 10 and the two fixing arms 51. Besides, while the sweeper machine of the present invention is lifted up from the floor, the torsion spring 23 overturns the garbage collection case 28 to make the garbage receiving opening of the garbage collection case 28 face upward and prevent the garbage from dropping out through the garbage receiving opening.

Refer to FIG. 2. The top of the body casing 24 includes an assembly opening corresponding to the top of the garbage collection case 28 and a garbage collection case cover 18 assembled to the assembly opening. The garbage collection case cover 18 is used to prevent the garbage inside the machine body 10 from rushing out of the assembly opening.

In conclusion, the sweeper machine of the present invention is driven manually and thus a human-powered sweeper machine exempted from the complicated and precision transmission device of an electric sweeper machine. Further, while the sweeper machine of the present invention is lifted up from the floor, the torsion spring instantly overturns the garbage collection case to make the garbage receiving opening face upward and prevent the garbage from dropping out from the garbage receiving opening. Therefore, the sweeper machine of the present invention has advantages of low cost and high reliability.

What is claimed is:

1. A sweeper machine, comprising:

a support frame, including two fixing arms, wherein each fixing arm includes a driving wheel, a first gear and a second gear, and wherein each of the driving wheel protrudes from a terminal of the fixing arm where the driving wheel is installed, and wherein the driving wheel is coaxially coupled to the second gear, and the second gear is meshed with the first gear, and wherein the first gear is further coaxially coupled to a driving shaft, and wherein the driving shaft is extended out of the fixing arm where the driving shaft is installed;

a machine body disposed between and mounted to the two fixing arms and including a body casing and a roll brush, wherein the roll brush is disposed inside the body casing, and wherein the body casing includes an opening formed and extended in a rear side of a bottom of the body casing, and wherein a lower part of the roll brush is exposed from the opening, and wherein a first connection hole is respectively formed on each of two ends of the body casing, and wherein each driving shaft, which extends out of each fixing arm, penetrates one of the first connection holes, and wherein each of two ends of the roll brush is respectively firmly connected with one of the two driving shafts; and a garbage collection case disposed in the opening in the rear side of the body casing and including a garbage receiving opening facing the roll brush.

2. The sweeper machine according to claim 1, wherein the support frame includes a main casing, and wherein the main casing includes two fixing-arm shells branching out toward the two lateral sides of the main casing, and wherein each fixing-arm shell includes a fixing-arm side cover on the outer side of the fixing-arm shell, and wherein each fixing-arm shell and the fixing-arm side cover thereof include an accommodation space therebetween, and wherein each accommodation space accommodates the driving wheel, the first gear and the second gear.

3. The sweeper machine according to claim 2, wherein each fixing-arm shell includes a first annular limit protrusion, and wherein each fixing-arm side cover includes a second annular limit protrusion, and wherein two sides of each second gear respectively include two annular positioning grooves separately assembled to the first annular limit protrusion and the second annular limit protrusion.

4. The sweeper machine according to claim 3, wherein the driving wheel has an annular shape, and wherein each driving wheel sleeves and engages with the outer side of one of the second gears, and wherein the second gear is an internal gear, and the first gear is an external gear, and wherein the first gear is disposed inside the second gear and meshed with the second gear.

5. The sweeper machine according to claim 2, wherein the top of the body casing includes an adapter, which is hinged to the body casing with a pin, and wherein the adapter is fixedly connected with a swing member, and wherein the swing member is connected with a sweeper handle by a connection member.

6. The sweeper machine according to claim 2, wherein each fixing-arm side cover includes a bump cover on the outer side thereof.

7. The sweeper machine according to claim 2, wherein a torsion spring is disposed between the machine body and each of the fixing arms, and wherein a machine-body side cover is respectively assembled to each of two sides of the body casing, and wherein each machine-body side cover includes a second connection hole coaxial with the first connection hole and an arc-shaped limit groove penetrating the machine-body side cover, and wherein the circle center of the arc-shaped limit groove is on the axis of the second connection hole, and wherein the rim of the first connection hole extends toward the corresponding machine-body side cover to form a fixing shaft, and wherein the body casing includes a limit block respectively at each of the two sides thereof, and wherein the torsion spring includes a helically-wound spring body and also includes a first spring arm and a second spring arm respectively extended from two ends of the spring body, and wherein the spring body sleeves the fixing shaft, and the first spring arm presses against the limit block, and wherein the fixing arm includes a limit pillar, and wherein the limit pillar is inserted into the arc-shaped limit groove and presses against the second spring arm.

8. The sweeper machine according to claim 1, wherein the garbage receiving opening includes a scraper strip disposed on the edge of the bottom of the garbage receiving opening and cooperating with the roll brush, and wherein the garbage collection case includes at least one recess concaved upward from the bottom thereof, and wherein an auxiliary roller is assembled in the recess.

9. The sweeper machine according to claim 1, wherein the top of the body casing includes an assembly opening corresponding to the top of the garbage collection case and a garbage collection case cover assembled to the assembly opening.

* * * * *